US005143139A

United States Patent [19]

Leatham et al.

[11] Patent Number: 5,143,139

[45] Date of Patent: Sep. 1, 1992

[54] SPRAY DEPOSITION METHOD AND APPARATUS THEREOF

[75] Inventors: Alan G. Leatham, Swansea; Charles R. Pratt, Neath, both of Wales; Peter F. Chesney, Duncanville, Tex.

[73] Assignee: Osprey Metals Limited, West Glamorgan, United Kingdom

[21] Appl. No.: 613,891

[22] PCT Filed: Jun. 6, 1989

[86] PCT No.: PCT/GB89/00626

§ 371 Date: Jan. 22, 1991

§ 102(e) Date: Jan. 22, 1991

[87] PCT Pub. No.: WO89/12115

PCT Pub. Date: Dec. 14, 1989

[30] Foreign Application Priority Data

Jun. 6, 1988 [GB] United Kingdom ..... 8813335
Feb. 7, 1989 [GB] United Kingdom ..... 8902722

[51] Int. Cl.[5] ..... B05C 5/04; C23C 4/12; B22F 9/08

[52] U.S. Cl. ..... 164/46; 75/338; 118/50.1; 118/72; 427/367; 427/38; 419/69

[58] Field of Search ..... 164/46, 70.1; 118/50.1, 118/72, 320; 148/2, 3; 75/338

[56] References Cited

U.S. PATENT DOCUMENTS

| | | | |
|---|---|---|---|
| 3,833,983 | 9/1974 | Baker et al. | 29/149.5 |
| 4,333,775 | 6/1982 | Mahrus | 148/11.5 Q |
| 4,697,631 | 10/1987 | Bungeroth et al. | 164/46 |
| 4,926,924 | 5/1990 | Brooks et al. | 164/46 |

FOREIGN PATENT DOCUMENTS

| | | | |
|---|---|---|---|
| 1050832 | 3/1979 | Canada . | |
| 119036 | 9/1984 | European Pat. Off. . | |
| 0156760 | 10/1985 | European Pat. Off. . | |
| 0172030 | 2/1986 | European Pat. Off. . | |
| 198613 | 10/1986 | European Pat. Off. . | |
| 0200349 | 11/1986 | European Pat. Off. . | |
| 8703012 | 5/1987 | European Pat. Off. . | |
| 225732 | 6/1987 | European Pat. Off. . | |
| 225080 | 10/1987 | European Pat. Off. . | |
| 0299944 | 1/1989 | European Pat. Off. . | |
| 810223 | 8/1951 | Fed. Rep. of Germany . | |
| 2558850 | 1/1984 | France . | |
| 62-107849 | 5/1987 | Japan | 164/76.1 |
| 1599392 | 9/1981 | United Kingdom . | |
| 2172827 | 10/1986 | United Kingdom | 164/46 |

*Primary Examiner*—George Wyszomerski
*Attorney, Agent, or Firm*—Brown, Martin, Haller & McClain

[57] ABSTRACT

There is provided a method of spray deposition in which a stream of liquid metal or metal alloy is atomized inside a spray chamber into a spray of atomized droplets. A metal or metal alloy collector is rotated about an axis transverse to the mean axis of the spray and in the path of the spray so that a deposit is formed about the collector with a bond between the deposit and the collector sufficient to isolate the interface from oxygen penetration. The collector is then retained as an integral part of the final product and further processed to substantially eliminate porosity in the region of the bonded interface. The collector and the deposit may be the same or different materials, and the bond between the deposit and the collector is preferably enhanced by plasma heating in the region disposition. The invention also provides a plant for carrying out the preferred method arc plasma heating.

26 Claims, 4 Drawing Sheets

SPRAY DEPOSITION METHOD AND APPARATUS THEREOF

Figure 1A:
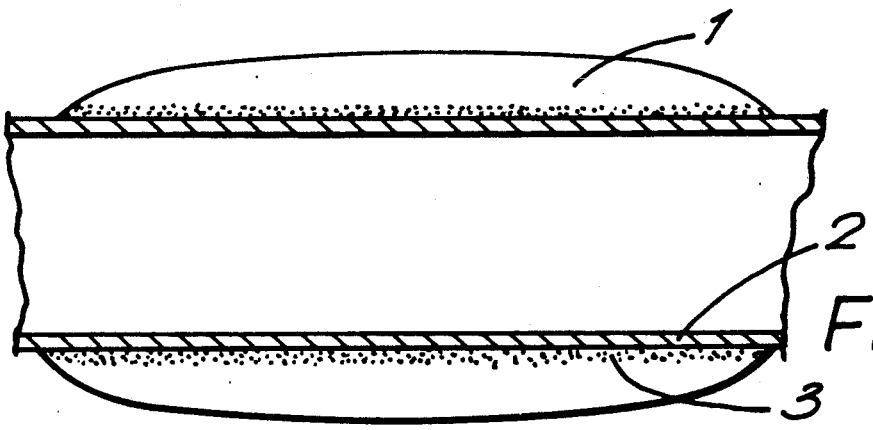

This invention relates to a method of spray deposition, to spray deposits formed by the method and to apparatus for carrying out the method.

In the production of spray-deposited, shaped preforms, liquid metal or metal alloy is sprayed onto an appropriate collector. The process is essentially a rapid solidification technique for the direct conversion of liquid metal into a deposit by means of an integrated gas-atomising/spray depositing operation. A controlled stream of molten metal is poured into a gas-atomising device where it is impacted by high velocity jets of gas, usually Nitrogen or Argon. The resulting spray of metal particles is directed onto the collector where the hot particles re-coalesce to form a highly dense deposit. The collector may be fixed to a control mechanism which is programmed to perform a sequence of movements within the spray, so that the desired deposit shape can be generated. Such deposits, after removal from the collector, can then be further processed, normally by hot-working, to form semi-finished or finished products.

The above methods are described in our European Patent Publications Nos. 200349; 198613; 225080; 244454, and 225732. It will be noted from these prior disclosures that for a high density spray deposit to be formed it is essential that the deposition conditions are so controlled that the atomised droplets are deposited onto a semi-solid/semi-liquid layer which is maintained at the surface of the spray deposit throughout the deposition operation. However, it is very difficult or often impossible to achieve this with the initially deposited layers of metal which are deposited onto the collector and not onto previously deposited metal. Consequently, the initially deposited metal can be chilled by heat conduction to the collector surface with the result that a semi-solid/semi-liquid surface is not immediately formed for subsequently arriving droplets to be deposited into. This results in poor bonding between the atomised droplets and also in individually deposited droplets often retaining their identity in the deposit resulting in porosity in the initially deposited layers of metal. When the collector is traversed through the spray this effect is further aggravated by the initially deposited metal being formed from the outer edges of the atomised spray where deposition rates are lower than in the centre regions of the spray. However, as the deposit increases in thickness, by careful control of the deposition conditions, the semi-solid/semi-liquid surface, into which the atomised droplets are deposited, is quickly generated and maintained resulting in high density, non-particulate microstructures, as described in our prior patents. The porosity which forms at the collector/deposit interface is nearly always interconnected with the result that oxygen from the atmosphere can penetrate into the pores during cooling of the deposit or during subsequent processing in an air atmosphere. For example, in the case of a stainless steel tube preform produced by traversing a thin walled, mild steel tubular collector through an atomised spray of stainless steel the interconnected porosity at the interface can be 10–20% of the deposit thickness. Consequently, current practice is to machine both the mild steel collector and the porous layer of stainless steel away from the tube before it can be used or further processed. This problem can be alleviated to a certain extent by preheating the collector but this is extremely difficult as the relatively cold atomising gas flowing over the surface of the preheated collector cools the surface of the collector prior to its passage under the spray and therefore reduces much of the benefit. Furthermore, to minimise porosity completely very high preheat temperatures are necessary, ideally at least to the solidus temperature of the metal being deposited and this can result in severe distortion of the collector and is often not practicable.

The removal of the collector by machining (particularly in the case of tubular deposits) and of part of the base of the spray deposit is very expensive and therefore undesirable. The use of refractory or ceramic insulating collectors is a possible method of reducing the chilling of the initially deposited metal and therefore the interface porosity but again in the case of tubular preforms the collector is difficult to remove as the spray deposit shrinks onto the tubular collector and even after its removal there is still some interface porosity, albeit reduced. Furthermore, the presence of a refractory product in the spray deposition chamber is considered undesirable as there is always a chance that refractory particles may be incorporated into the deposit thereby detracting from its metallurgical properties.

According to the present invention there is provided a method of spray deposition comprising the steps of atomising a stream of liquid metal or metal alloy into a spray of atomised droplets, providing a metal or metal alloy collector supported for rotation about an axis transverse to the mean axis of the spray, rotating the collector about its axis, directing the spray of atomised droplets at the collector so that a deposit is formed about the collector with a bond between the deposit and the collector sufficient to isolate the interface from subsequent oxygen penetration, retaining the collector as an integral part thereof, and further processing the integral deposit and collector to substantially eliminate porosity in the region of the bonded interface. Preferably the collector is first preheated in an inert or reducing atmosphere.

The bond at the interface between the collector and the deposit may be a mechanical or metallurgical bond or a combination of the two but is such that oxygen cannot penetrate along the interface and enter any interconnected porosity present in the initially deposit layers of metal. With such a method any porosity at the interface is isolated from atmosphere by the retention of the collector as an integral part thereof with the bond between the collector and the deposit making it impermeable to the atmosphere. The collector may be the same metal or metal alloy as being sprayed or may be different.

The step of further processing may comprise processing either by hot isostatically pressing or by hot working means (e.g. extrusion, forging or rolling) such that the porosity at the interface remains isolated from the atmosphere during subsequent processing and is substantially eliminated by subsequent processing. In addition, if not already generated during spray-deposition, a complete metallurgical bond is generated at the collector/deposit interface by means of further processing.

After further processing, the original collector can subsequently be removed from such article, for example, by machining without having to machine away any significant amount of the original deposit as all porosity has been eliminated. Alternatively, part of the collector can be machined away leaving an article consisting of two materials (ie. the original deposit and part of the collector) as a compound product. A further alternative is for the complete collector to remain part of the finished or semi-finished article, also as a compound product.

The original collector can be in many forms including that of a simple tube, a hollow conical shape, a solid round, or a square bar for example. The collector can also be of the same composition or a different composition from that of the spray deposit.

In accordance with the invention it is preferable to preheat the collector. Whilst it has already been pointed out that high preheat temperatures at the collector surface are difficult to generate because of the cooling effect of the atomising gas as it flows over the surface of the collector prior to it entering under the spray, nevertheless some preheat is desirable. Whilst the preheat will only reduce but not eliminate porosity it is beneficial in reducing any contraction forces which exist between the depositing metal and the collector-in some cases the depositing metal can crack either longitudinally or transversely as a result of such stresses.

Preheating overcomes this problem and preheating is also an advantage in that it helps prevent lifting of initially deposited droplets onto the collector which can leave a pathway for oxygen penetration. Furthermore, preheating results in closer contact between the deposited metal and the collector also making oxygen penetration more difficult during subsequent processing. It is essential that the preheating operation is carried out in an inert or reducing atmosphere often in the spray chamber or an interconnecting chamber prior to the deposition operation which is also carried out under inert atmosphere. Preheating is generally applied in the temperature range between room temperature and the solidus temperature of the collector, preferably towards the solidus temperature, so that a metallurgical bond is to be formed or partly formed. In most embodiments of the invention it is also essential that the collector surface is pre-conditioned prior to the preheating and the spray deposition operation or simultaneously with the preheating step. Any oxide scale or oxide films must be removed from the surface of the collector by suitable surface cleaning techniques. The presence of an oxide film will deter from any mechanical or metallurgical bonding of the deposit to the collector either during spray deposition or during subsequent processing. In many situations the collector is prepared by grit blasting which will remove any oxide film and will also provide a mechanical key for the initially deposited droplets of atomised metal to bind onto thereby maintaining a very close contact at the interface.

Generally, the collector has a higher melting point than the metal being deposited, particularly in the case of thick deposits. However, in certain situations it is possible to spray deposit onto a collector of lower melting point and the conduction of heat from the deposit to the collector assists in the generation of a metallurgical bond but is insufficient to melt the collector.

Any preheating techniques can be used such as high frequency induction heating, resistance heating, gas heating, et. However, it has been found that plasma preheating is particularly advantageous as a plasma torch can be located very close to the deposition zone or can even be directed at the first layers of metal being deposited assisting in the formation of a strong bond at the interface. Furthermore the ionised gas from a plasma can be used to very rapidly preheat the surface of the collector and is also beneficial in removing any residual oxide film as a result of the impact of the high velocity gas onto the surface of the collector.

Therefore, preferably the preheating and conditioning steps are carried out simultaneously by preheating the surface of the collector to be introduced into the path of the spray by applying to the collector a plasma arc of ionised gas which rapidly heats the surface of the collector and/or of the initially deposited metal. Additionally, the plasma may be a carrier and heater for the introduction of hot fine particulate materials into the stream or spray of molten metal or metal alloy.

The invention also includes a metal or metal alloy deposit or finished articles in which the collector onto which the spray is directed forms an integral part.

The present invention is applicable to all substantially axi-symmetric spray deposits, e.g. ingots, bar, tubes, extrusion or forging blanks, finished articles, composite products, coated products. For example, aluminium/-silicon alloy may be sprayed onto a pure aluminium, or an aluminium alloy, or an aluminium/silicon alloy of same composition, in the form of a thin wall tubular collector and extruded to make automotive cylinder liners without the need to remove the collector prior to (or sometimes even after in the case of the same composition) the extrusion operation. If desired, ceramic particles may be introduced into the stream or spray to improve high temperature properties or strength and wear resistance of the resulting deposit. The collector itself may have particularly required properties, e.g. corrosion resistance or abrasion resistance and may provide a simple way of providing a special coating, e.g. on the inside of an assprayed cheaper material. The invention may also be used in conjunction with one or more sprays either of the same or of different compositions including the introduction of particulate into one or more of the sprays.

The invention also includes apparatus for spray depositing a compound product comprising a spray chamber for providing an inert or reducing atmosphere, a metal or metal alloy collector within the spray chamber, means for providing a controlled stream of molten metal or metal alloy within a spray chamber, and gas atomising means for forming a spray of atomised droplets from the stream and for applying them to the collector to form a deposit thereon, means for moving the collector relative to the spray, plasma heating means for simultaneously conditioning the surface of the collector to remove oxide film thereon and for preheating the collector as it is moved into the path of the atomised droplets whereby a metallurgical bond is formed or partly formed between the depositing metal or metal alloy and the collector, and means for further processing the deposit and the collector as an integral product to reduce porosity at the bonded interface. Our previous European Patent Publication No. 225732 describes a method of producing a spray deposited bar or billet by oscillating an atomised spray of metal across the surface of a rotating disc shaped collector and retracting the collector along its axis of rotation at the same rate as the spray deposit increases in length. Such a method has been found to produce acceptable results on billets up to about 300 mm in diameter but larger diameters are more difficult to produce as a result of excessive heat build up in the central regions, sometimes leading to metallurgical defects such as hot tearing. An alternative method for billet production can be used by means of the present invention. However, in this case the collector is a round bar, generally of small diameter, and of the same composition of the metal or alloy to be sprayed. In this case, the collector is conditioned, rotated and preheated to a temperature less than the solidus of the metal being spray-deposited and passed under the spray. Subsequent hot working or hipping eliminated interface porosity and produces a bar of one alloy. For large diameter bars (e.g. 300–600 mm diameter) several atomised sprays can be used in sequence. A benefit of this technique is that the collector can act as a heat sink in the centre of the spray deposited billet thus preventing the metallurgical defects described earlier.

Figure 1B:
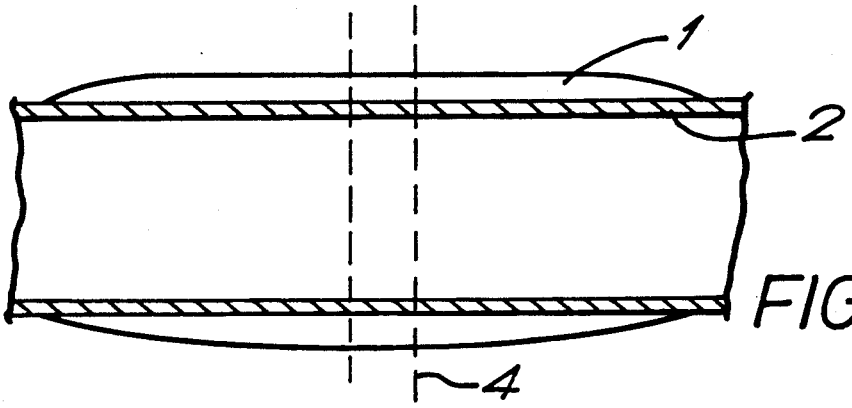
Figure 1C:
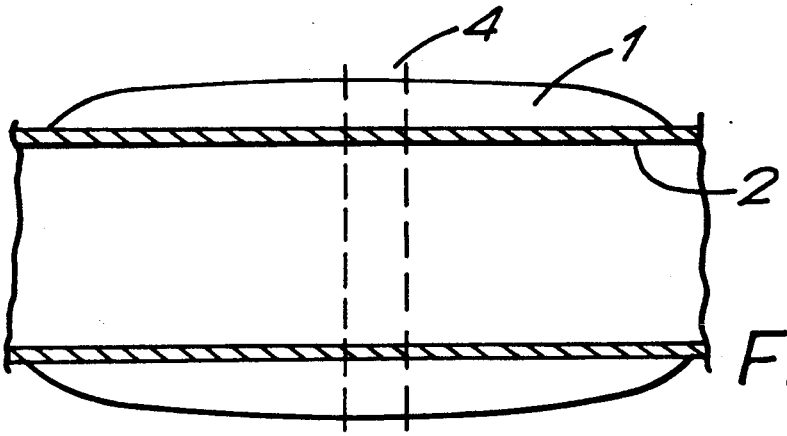
Figure 2A:
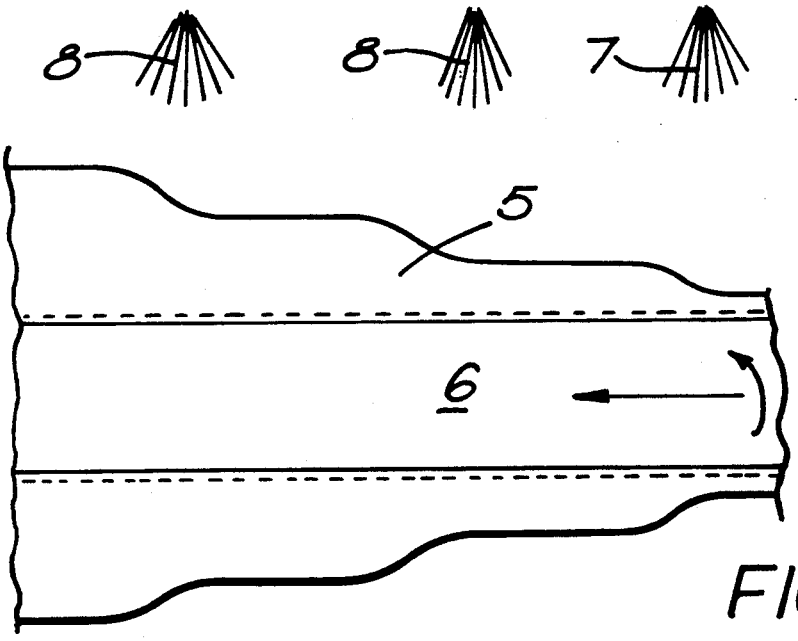
Figure 2B:
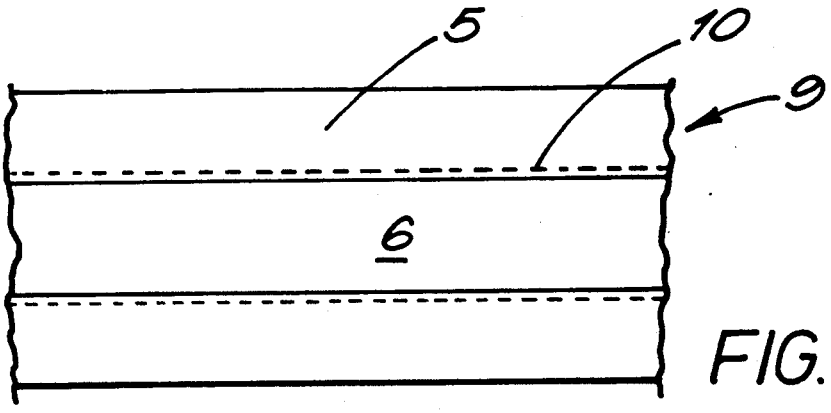
Figure 2C:
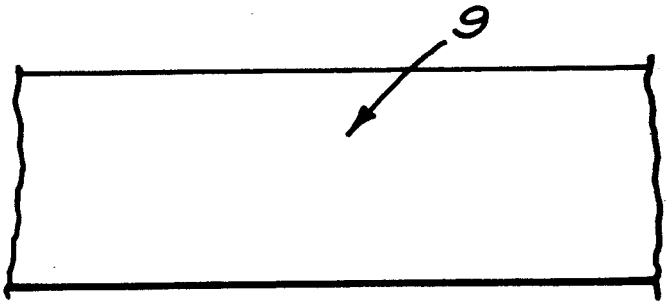
Figure 3A:
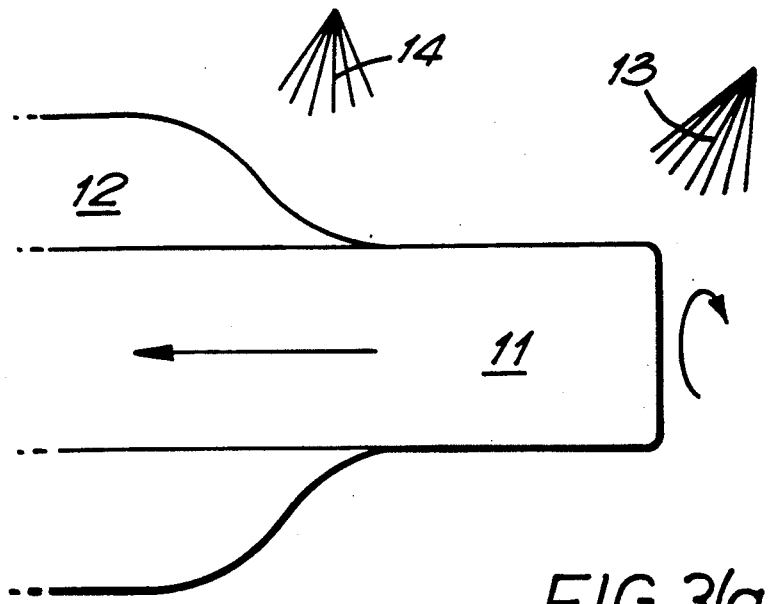
Figure 3B:
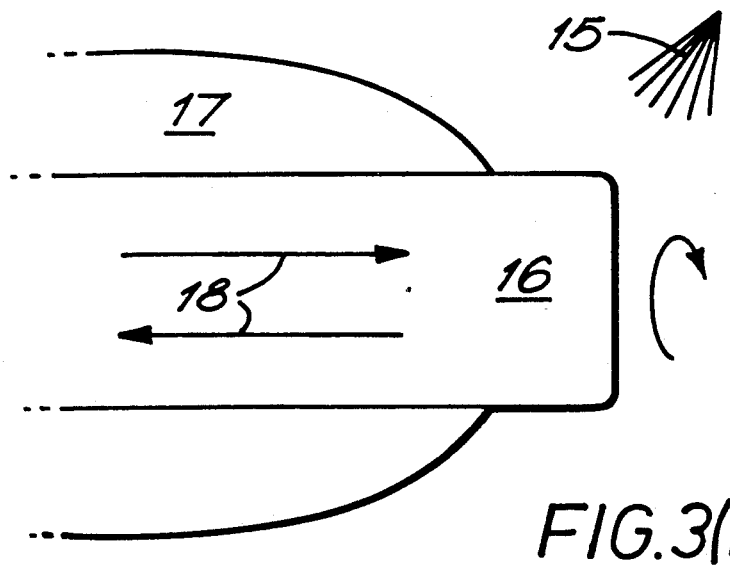
Figure 4:
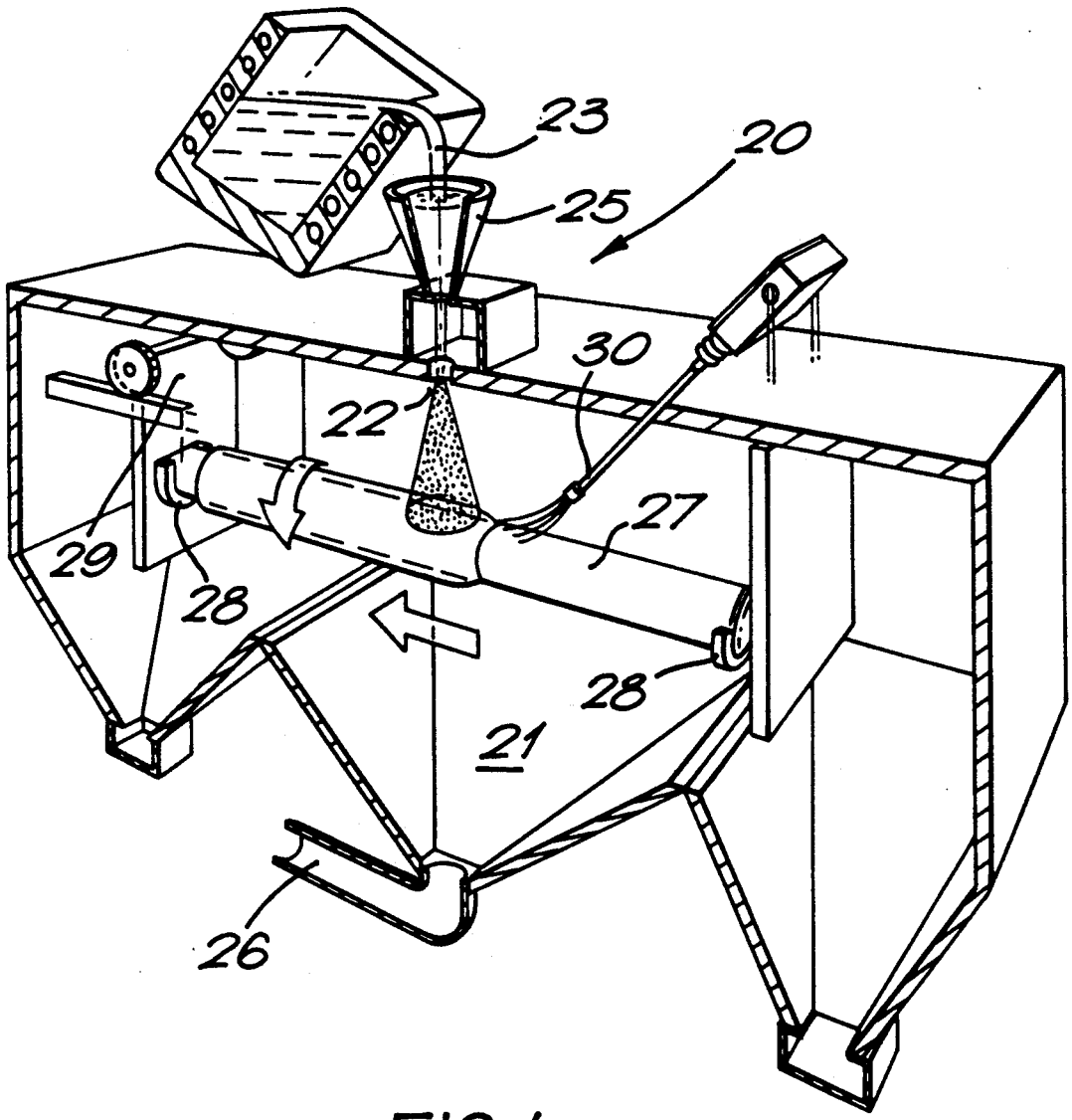

Therefore, according to a further aspect of the invention there is provided a method of spray deposition comprising atomising a liquid metal or metal alloy in a spray chamber to form a spray of atomised droplets, providing a metal or metal alloy collector of substantially the same composition as the metal or metal alloy being sprayed, rotating the collector about an axis transverse to the mean axis of the spray, directing the spray of atomised droplets at the collector so that the metal or metal alloy is deposited thereon, and consolidating the collector and the deposit to close any interface porosity between the collector and the deposit such that they become a unitary body of substantially consistent composition throughout. Another aspect of the invention is to spray deposit the collector in addition to the subsequent spray coating. One possibility in this case is to use two or more sprays of the same alloy preferably all being fed with molten alloy from a common tundish. However, in one or more but not all of the sprays injected particles are introduced so that one or more of the layers deposited from the spray consists of a metal matrix composite. An example of this is a tube consisting of an initially deposited layer (deposited onto a thin walled mild steel collector rotating and traversing through the spray) of low alloy steel into which alumina particles are injected. The initially deposited composite layers of low alloy steel/alumina then acts as the collector for a second layer of low alloy steel only to be deposited on. Such a product will provide a balance of properties with a high wear resistance on the interior of the tube but a high toughness on the outside. Compound bar can be manufactured in this way using a starting bar as a collector and then depositing two or more layers from two or more sprays of an alloy with at least one of the sprays being injected with particles (e.g. ceramic) of a different material. The invention will now be described by way of example with reference to the accompanying drawings in which:

FIGS. 1(*a*) to 1(*c*) illustrate diagrammatically the formation of a tubular deposit in accordance with the present invention;

FIGS. 2(*a*) to 2(*c*) illustrate diagrammatically the formation of a solid bar deposit in accordance with the invention;

FIGS. 3(*a*) and 3(*b*) illustrate diagrammatically the formation of a solid bar deposit of consistent composition throughout its thickness; and FIG. 4 illustrates diagrammatically a plant in accordance with the present invention for forming the products of the present invention.

In FIG. 1(*a*) metal or metal alloy (1) is shown having been spray deposited onto a tubular metal collector (2) which preferably has been preheated and possibly grit-blasted. The collector (2) has been rotated to form the deposit which firmly engages the collector due to contraction stresses of the deposit as it cools and expansion forces of the tubular collector as it heats up. However, due to the temperature differential between the depositing metal (1) and the collector (2) a layer of porosity (3) is present at the interface. Whilst the porosity is sealed by means of the collector, the bond between the deposit and the collector and the interacting stress forces of contraction and expansion, the porosity still needs to be eliminated. The collector (2) and deposit (1) are therefore removed from the spray chamber and, instead of the collector and porosity (3) being machined away as in the past, the collector (2) and deposit (1) are retained as an integral product and further processed to eliminate the porosity either by hot working (e.g. extrusion or rolling where a change of shape is involved as illustrated in FIG. 1(*b*)) or by hot isostatic pressing where no change in shape is involved (FIG. 1(*c*)). Once the porosity has been eliminated—without oxidation as the porosity has remained sealed from atmosphere during the further processing—the collector may be machined away (without the previous wastage of the deposit) or the collector can be retained as part of the final product, e.g. as a ring as indicated by the dotted lines (4) in FIGS. 1(*b*) and 1(*c*).

In FIG. 2(*a*) a spray deposit (5) is formed on a solid rotating collector (6) by means of a spray (7). In order to increase the thickness of the deposit the collector (6) is simultaneously traversed laterally and passed through further sprays (8) which apply further metal deposited material until a composite body (9) is produced as shown in FIG. 2(*b*). However, as in the first arrangement porosity (10) is likely to be present at the interface and although this is sealed within the deposit for the reasons mentioned above, the porosity (10) must be eliminated. The composite body (9) is therefore worked until a metallurgical bond at the interface is complete and no porosity remains as indicated in FIG. 2(*c*). The collector (6) may be the same or of a different composition to the metal being sprayed. In FIGS. 3(*a*) and 3(*b*) the collector (11) is the same as the metal or metal alloy (12) being sprayed and, in fact, the collector (11) itself is formed by spray deposition from spray (13). Thus, in FIG. 3(*a*), the collector deposit (11) is formed in the manner disclosed in our prior European Patent Publication No. 225732 and then the rotating collector is passed beneath a second spray (14) of the same metal or metal alloy material perhaps fed by the same tundish (not shown) to increase the size of the deposit.

Alternatively, as shown in FIG. 3(*b*), a single spray (15) may be used first to build up the collector (16) by movement in a first direction and then to increase the thickness of the deposit (17) by movement in the opposite direction (see arrows 18).

FIG. 4 shows a preferred plant (20) for making tubular deposits. The plant (20) includes an enclosed atomising chamber (21) having an inlet nozzle (22), through which molten metal or metal alloy (23) is teemed from a tundish (25), and an exhaust outlet (26) for spent atomising gas and the recycling of overspray powder. Disposed within the chamber (21) is a tubular collector (27) which is supported between insulated chucks (28) on a moveable trolley (29). The moveable trolley (29) is operative to move the collector (27) axially in the direction of the arrow and the collector is arranged to rotate about its axis. Disposed immediately upstream of the deposition surface is a plasma heating means (30) which pre-heats and cleans the surface of the collector (27) prior to deposition. The collector is suitably heated to a temperature greater than 20% of the melting temperature of the metal being sprayed.

In use, the molten metal is atomised at the inlet (22), suitably by an atomising device as disclosed in our copending published application No. 225080. The atomoized droplets are then deposited on the surface of the collector which has been preheated by means of the plasma heating means (30). The preheating, in conjunction with optimum deposition conditions ensures that the deposit forms a firm metallurgical bond with the collector. The deposition conditions are controlled such that the heat extraction is sufficient to ensure that the atomised droplets being cooled in flight by the relatively cold atomising gas are deposited into a surface film of semi-liquid/semi-solid metal. Once the deposition operation has been completed the collector (27) is removed from the chucks (28) for subsequent working as required. If desired, the plasma heating means may be arranged to generate a thin liquid layer on the surface of the collector from the material of the collector itself, e.g. 100 microns thick. Due to the localised nature of the heating the melting of the surface of the collector to this degree would have no adverse effect on the structure of the collector.

By incorporating a plasma head within the spray chamber several advantages over induction heating are obtained, namely:

(i) because of the rapid release of a large amount of energy only the surface of the collector is heated very quickly;

(ii) it is much easier to keep the workpiece clean on heating, firstly, because the heating is undertaking within the spray chamber and, secondly, because the plasma has the effect of cleaning the surface of the workpiece;

(iii) the plasma head is easily directionable and therefore could be movably mounted as mentioned above. Accordingly, in addition to preheating the collector, the plasma head may, in addition, be used for the application of additional heat in areas of a deposit previously prone to chilling thereby reducing the chill factor. This would be the case where the edge of a spray cone or where a deposited surface were out of the spray for a certain amount of time;

(iv) it enables the heating zone to be close as possible to the spray. In most other methods of heating, the surface of the hot substrate is chilled below a bonding temperature by convection losses to the atomising gas. The plasma arc can be arranged to overlap the spraying zone thereby keeping the surface hot in the spraying zone;

(v) the use of plasma avoids the need for a special induction coil for each shape and size of product to be heated, e.g. round coils for tubes. Furthermore, for surface heating only it would be necessary to select a specific frequency for each depth of heating required which would require a complicated and expensive induction generator;

(vi) if an induction coil were used the overspray could adhere to the coil box because it would be necessary to keep the induction coil close to the spraying zone this could result in a local disruption in the coating being applied to the collector. The use of a plasma heating torch enables it to be kept clear of the spraying zone because the plasma torch can be situated well above the atomising zone and well away from overspray powders. Moreover, although it is shown above, it could be positioned below and in line with the point of deposition.

(vii) a plasma arc, when used in accordance with the invention, can be easily moved by mechanical methods to cover large surface areas. Alternatively, the plasma arc can be scanned at a high frequency by using a pulsed magnetic field. This is not readily achieved with conventional techniques; and, (viii) injection particles, as disclosed for example in our copending published application No. 198613 can be added through the plasma torch. The addition of particles through the plasma enables the particles to be preheated before entering the deposit. In certain cases this can promote improved wetting between the injected particles and the co-depositing matrix which can improve the quantity of composite coatings particularly for thin layers.

A typical example of a compound billet of two different materials is as follows:

| COMPOUND BILLET EXAMPLE I | |
|---|---|
| Collector Material | Al-4% Cu bar |
| Deposited Material | Al-20% Si |
| Metal Pouring Temperature | 810 degrees C. |
| Spray Height | 580 mm |
| Metal Stream Diameter | 4.5 mm |
| Collector Pre-heat Temperature | 400 degrees C. (using an induction coil located inside the spray chamber) |
| Metal Flow Rate | 6 kg/min |
| Atomising Gas | Nitrogen |
| Gas:Metal Ratio | 3.8 CuM/kg |
| Collector Rotation | 200 rpm |
| Collector Size | 300 mm long 180 mm dia |
| Preparation | Wire brushed in chamber |
| Deposit Thickness | 28–30 mm |
| Deposit Length | 270 mm |
| Traverse Speed | 0.88 mm/sec in a single pass under the spray |

During the spray-deposition operation only a partial metallurgical bond was formed at the collector/deposit interface and a small amount of porosity was also found to be present.

However, all porosity was subsequently eliminated and a complete metallurgical bond formed between the two alloys by subsequent hot extrusion to 100 mm diameter bar at 370 degrees C.

An example of a compound billet of the same materials is as follow:

| COMPOUND BILLET EXAMPLE II | |
|---|---|
| Collector Material | Al-20% Si |
| Deposited Material | Al-20% Si |
| Liquid Metal Temperature | 810 degrees C. |
| Spray Height | 620 mm |
| Metal Stream Diameter | 4.5 mm |
| Metal Flow Rate | 6 kg/min |
| Collector Preheat Temperature | 410 degrees C. (by induction coil inside the spray chamber) |
| Atomising Gas | Nitrogen |
| Gas:Metal Ratio | 3.7 |
| Collector Rotation | 220 rpm |
| Collector Size | 80 mm dia × 300 mm long |
| Preparation | Wire brushed in chamber |
| Deposit Thickness | 38 mm |
| Deposit Length | 280 mm |
| Reciprocation Frequency of Collector | 1 Hz |

During the spray-deposition operation only a partial metallurgical bond was formed at the collector/deposit interface and a small amount of porosity was also found to be present.

However, all porosity was subsequently eliminated and a complete metallurgical bond formed by hot extrusion at 370 degrees C. to produce bar of 50 mm diameter.

The collector and the deposit being of the same alloy substantially all evidence of the original interface was lost during extrusion. Further examples of the invention are now disclosed:

| COMPOUND BILLET EXAMPLE III (TWO DIFFERENT MATERIALS) | |
|---|---|
| Collector Material | 0.2% C Steel bar |
| Deposited Material | High speed steel grade M2 |
| Metal Pouring Temperature | 1530 degrees C. |
| Spray Height | 520 mm |
| Metal Stream Diameter | 6.5 mm |
| Collector Preheat-Temperature | 450 degrees C. (using a plasma torch located inside the spray chamber) |
| Metal Flow Rate | 33 kg/min |
| Atomising Gas | Nitrogen |
| Gas:Metal Ratio | 0.68 CuM/kg |
| Collector Rotation | 180 rpm |
| Collector Size | 3000 mm long 75 mm dia |
| Preparation | Grit blasted |
| Deposit Thickness | 48 mm |
| Deposit Length | 650 mm |
| Traverse Speed | 2.9 mm/sec in a single pass under the spray |

During the spray deposition operation only a partial metallurgical bond was formed at the collector/deposit interface and a small amount of porosity was also found to be present.

However, all porosity was subsequently eliminated and a complete metallurgical bond formed between the two alloys by subsequent hot forging to 76 mm diameter bar at 1130 degrees C. in a GFM machine.

| COMPOUND BILLET EXAMPLE IV (SAME ALLOY) | |
|---|---|
| Collector Material | High speed steel grade T15 |
| Deposited Material | High speed steel grade T15 |
| Metal Pouring Temperature | 1515 degrees C. |
| Spray Height | 520 mm |
| Metal Stream Diameter | 6.5 mm |
| Metal Flow Rate | 36.5 kg/min |
| Collector Preheat Temperature | 560 degrees C. (by induction coil inside the spray chamber) |
| Atomising Gas | Nitrogen |
| Gas:Metal Ratio | 0.57 CuM/kg |
| Collector Rotation | 180 rpm |
| Collector Size | 70 mm dia × 750 mm long |
| Preparation | Grit blasted |
| Deposit Thickness | 42 mm |
| Deposit Length | 600 mm |
| Traverse Speed | 3.2 mm/sec in a single pass under the spray |

During the spray-deposition operation only a partial metallurgical bond was formed at the collector/deposit interface and a small amount of porosity was also found to be present.

However, all porosity was subsequently eliminated and a complete metallurgical bond formed by hot forging at 1140 degrees C. to produce a bar of 78 mm diameter in GFM machine.

The collector and the deposit substantially being of the same alloy all evidence of the original interface was lost during hot working.

We claim:

1. A method of spray deposition comprising the steps of:

providing a spray chamber;

atomizing a stream of liquid metal or metal alloy inside the spray chamber into a spray of atomized droplets, the spray having a mean axis;

providing a metal or metal alloy collector supported for rotation about an axis transverse to the mean axis of the spray;

conditioning the surface of the collector by grit blasting to remove impurities therefrom and to provide a key for a mechanical bond for atomized droplets deposited thereon;

rotating the collector about its axis;

directing the spray of atomized droplets at the collector so that a deposit is formed about the collector with a mechanically bonded interface between the deposit and the collector sufficient to isolate said interface from oxygen penetration;

retaining the collector as an integral part with said deposit; and working the integral deposit and collector to substantially eliminate porosity in the region of the bonded interface.

2. A method according to claim 1 comprising preheating the collector prior to said directing step in an inert or reducing atmosphere, the step of preheating the collector being selected from the group consisting of induction heating, resistance heating, gas heating or plasma heating.

3. A method according to claim 2 wherein the preheating is applied in the temperature range between room temperature and the solidus temperature of the collector.

4. A method according to claim 1 comprising the further step of preheating the collector by plasma heating prior to said directing step whereby a metallurgical bond forms during the directing step at the interface between the deposit and the collector.

5. A method according to claim 1 comprising the additional steps of moving the collector laterally relative to the spray, and applying a plasma arc to the surface of the collector as it moves into the path of the atomized droplets for deposition onto said surface.

6. A method according to claim 5 wherein the plasma arc is also applied to the initially deposited metal or metal alloy to assist in the formation of a strong metallurgical bond at the interface between the collector and the deposit.

7. A method according to claim 6 comprising the further step of introducing particulate material into the spray of atomized droplets by means of said plasma for co-deposit therewith.

8. A method according to claim 1 wherein said working step comprises a hot isostatic pressing or hot working to substantially eliminate porosity and to form a complete metallurgical bond.

9. A method according to claim 8 comprising the further step of removing the whole or part of the collector to leave just the deposit or a compound product respectively.

10. A method according to claim 1 wherein the collector is of substantially the same material as the material being sprayed.

11. A method of spray deposition comprising:

atomizing a liquid metal or metal alloy in a spray chamber to form a spray of atomized droplets;

providing a metal or metal alloy collector of substantially the same composition as the metal or metal alloy being sprayed;

rotating the collector about an axis transverse to the mean axis of the spray;

directing the spray of atomized droplets at the collector so that the metal or metal alloy is deposited thereon; and consolidating the collector and the deposit to close any interface porosity between the collector and the deposit such that they become a unitary body of substantially consistent composition throughout;

said providing step comprising moving said spray in a first direction as to form the collector by spray deposition, and said direction step comprising subsequently depositing said metal or metal alloy by passing the collector under the spray in a direction substantially opposite to the first direction in which the collector was formed.

12. A method according to claim 11 further comprising subsequently depositing an additional metal or metal alloy by one or more additional sprays.

13. A method according to claim 12 wherein at least one or more of the additional sprays includes the application of solid particles of different composition to provide a localized layer having a different composition from the rest of the unitary body.

14. A method of spray deposition comprising atomizing a liquid metal or metal alloy into a spray, directing the spray at a collector to form a deposit thereon, moving the collector relative to the spray so that an elongate first deposit is formed thereon, subsequently positioning said first deposit as a mandrel transverse to a spray of metal or metal alloy of substantially the same composition as the spray from which the mandrel was formed rotating the mandrel about its longitudinal axis so that a second deposit of metal or metal alloy is deposited along the length of the mandrel thereby increasing the diameter thereof, and supporting the second deposit and the mandrel during subsequent working to close any interface porosity between the mandrel and the second deposit such that the mandrel and second deposit become a unitary body of substantially consistent composition throughout.

15. A method according to claim 14 wherein the first or second deposit includes ceramic particles therein applied during the spray deposition process.

16. A method of spray deposition comprising the steps of:

providing a spray chamber;

atomizing a stream of liquid metal or metal alloy of a first composition inside the spray chamber into a spray of atomized droplets having a mean axis;

providing a metal or metal alloy collector of a second, different, composition supported for rotation about an axis transverse to the mean axis of the spray;

roughening the surface of the collector to provide a key for a mechanical bond for atomized droplets deposited thereon;

rotating the collector about its axis;

directing the spray of atomized droplets at the collector so that a deposit is formed about the collector and a bonded interface is formed between the deposit and the collector;

retaining the collector as an integral part with said deposit, working the integral deposit and collector by extrusion to substantially eliminate porosity in the region of the bonded interface; and extruding the deposit and the collector as a compound tube the outside of which is of said first composition and the inside of which is of said second composition.

17. A method of spray deposition comprising:

atomizing a liquid metal or metal alloy in a spray chamber to form a spray of atomized droplets;

providing a metal or metal alloy collector of substantially the same composition as the metal or metal alloy being sprayed;

roughening the surface of the collector to provide a key for a mechanical bond for atomized droplets deposited thereon;

preheating the collector whereby atomized droplets deposited thereon form a metallurgical bond with the collector;

rotating the collector about an axis transverse to a mean axis of the spray;

directing the spray of atomized droplets at the collector so that the metal or metal alloy is deposited thereon, and bonds thereto by mechanical and metallurgical bonding; and consolidating the collector and the deposit to close any interface porosity between the collector and the deposit such that they become a unitary body of substantially consistent composition throughout.

18. A method according to claim 17 wherein the preheating step comprises plasma heating.

19. A method according to claim 17 comprising the additional step of:

moving the collector laterally relative to the spray; and wherein said preheating step comprises preheating the collector by applying a plasma arc to the surface of the collector as it moves into the path of the atomized droplets for deposition onto said surface.

20. A method according to claim 19 wherein the plasma arc is also applied to the initially deposited metal or metal alloy to assist in the formation of a strong metallurgical bond at the interface between the collector and the deposit.

21. A method according to claim 17 wherein the collector comprises a spray deposited metal or metal alloy of substantially the same composition as the metal or metal alloy to be deposited subsequently.

22. A method of spray deposition comprising:

atomizing a liquid metal or metal alloy into a spray of atomized droplets;

providing a collector of metal or metal alloy;

roughening the surface of the collector to provide a key for a mechanical bond for atomized droplets deposited thereon;

preheating the collector by means of a plasma arc whereby atomized droplets deposited thereon form a metallurgical bond with the collector;

directing the spray at the collector to form a deposit thereon;

moving the collector relative to the spray so that an elongate deposit is formed thereon;

hot working the deposit and the collector together to close any interface porosity between the collector and the deposit such that they become a unitary body.

23. A method according to claim 22 wherein the collector is selected from the group consisting of tubular shape, hollow conical shape, solid round, or square bar.

24. Apparatus for spray depositing a compound product comprising:

a spray chamber for providing an inert or reducing atmosphere;

a metal or metal alloy collector within the spray chamber;

atomizing means providing a controlled stream of molten metal or metal alloy within the spray chamber;

at least two gas atomizing means for forming respective sprays of atomized droplets from the stream and for applying them to the collector to form a deposit thereon;

means for moving the collector relative to the sprays;

plasma heating means for simultaneously conditioning the surface of the collector to remove oxide film thereon and for preheating the collector as it is moved into the path of the atomized droplets whereby a metallurgical bond is formed at the interface between the deposited metal or metal alloy and the collector; and means for working the deposit and the collector as an integral product to reduce porosity at the bonded interface.

25. Apparatus according to claim 24 wherein the collector is selected from the group consisting of tubular shape, hollow conical shape, solid round, or square bar.

26. Apparatus according to claim 24 wherein the means for working comprises hot isostatic pressing means.

* * * * *

UNITED STATES PATENT AND TRADEMARK OFFICE

CERTIFICATE OF CORRECTION

PATENT NO. : 5,143,139

DATED : September 1, 1992

INVENTOR(S) : Alan G. Leatham, et al.

It is certified that error appears in the above-identified patent and that said Letters Patent is hereby corrected as shown below:

Claim 11, Column 11, Line 15, delete "direction" insert --directing--

Signed and Sealed this

Ninth Day of November, 1993

Bruce Lehman

*Attest:*

BRUCE LEHMAN

*Attesting Officer*

*Commissioner of Patents and Trademarks*